United States Patent [19]

Magyari et al.

[11] Patent Number: 4,915,182

[45] Date of Patent: Apr. 10, 1990

[54] CUTTER ELEMENTS FOR HOLLOW DRILL BIT

[75] Inventors: Eugen Magyari, Vorburg, Liechtenstein; Walter Ritt, Schnifis, Austria

[73] Assignee: Hilti Aktiengesellschaft, Liechtenstein

[21] Appl. No.: 374,362

[22] Filed: Jun. 30, 1989

[30] Foreign Application Priority Data

Jul. 1, 1988 [DE] Fed. Rep. of Germany ..... 3822249

[51] Int. Cl.[4] ..... E21B 10/02; E21B 10/44

[52] U.S. Cl. ..... 175/403; 175/394; 175/410

[58] Field of Search ..... 175/402, 403, 404, 405, 175/410–412, 393–396

[56] References Cited

U.S. PATENT DOCUMENTS

| | | | |
|---|---|---|---|
| 817,296 | 4/1906 | Besson | 175/403 X |
| 1,168,226 | 1/1916 | Rand | 175/403 X |
| 1,172,139 | 2/1916 | Jenkins | 175/403 |
| 1,846,177 | 2/1932 | Bascom et al. | 175/403 |
| 2,520,876 | 8/1950 | Bullock | 175/403 |
| 3,217,816 | 11/1965 | Boyer | 175/403 X |

*Primary Examiner*—Stephen J. Novosad

*Attorney, Agent, or Firm*—Toren, McGeady & Associates

[57] ABSTRACT

A hollow drill bit is formed of an axially extending tubularly-shaped support member (1) with cutter elements (2) inserted into the leading end (1*a*) of the support member. Each cutter member (2) has a radially outer surface (2*a*) and a radially inner surface (2*b*) with channels (2*c*, 2*d*) in each surface inclined relative to the axis of the support member (1). The channels (2*c*,2*d*) carry a flowable cooling agent to the leading end of the drill bit, and remove drillings produced by the bit from the leading end.

6 Claims, 1 Drawing Sheet

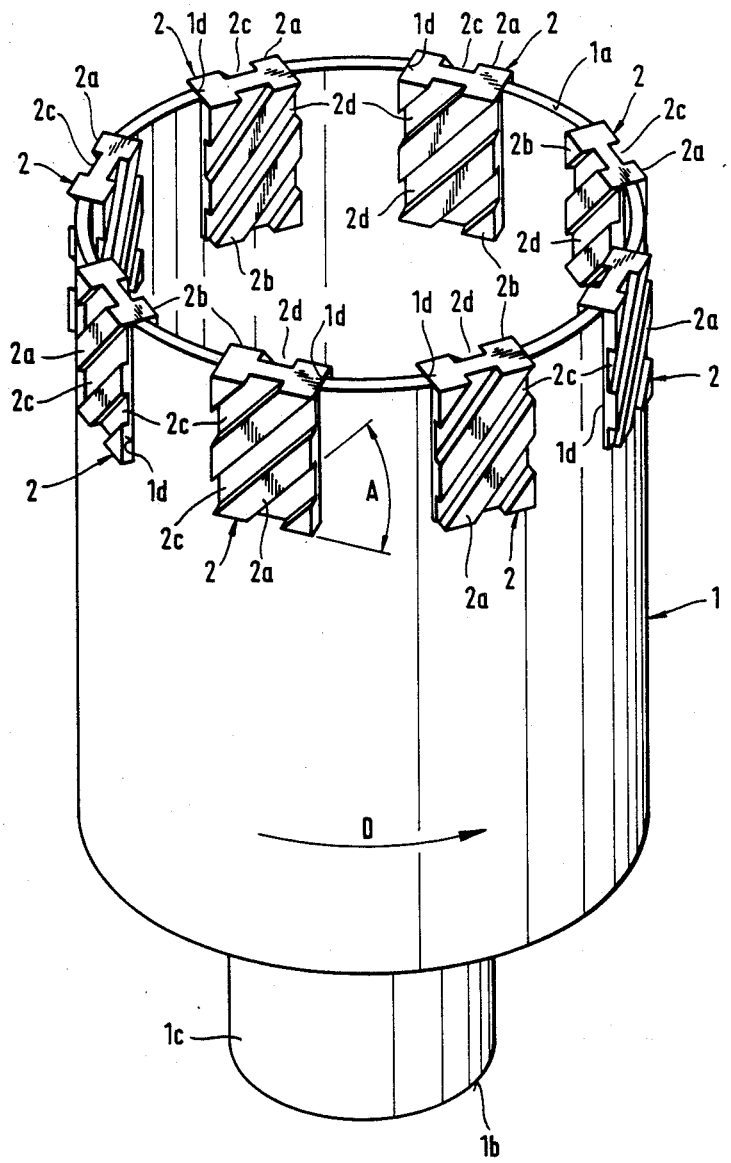
2
1d
2c
2a
1d
2c
2a
2
1a
2a
2c
2d
2
2c
2b
2a
2d
2d
2b
2b
2d
1d
1d
2d
2b
2a
2a
2c
2c
2
2c
1d
2
1d
A
2c
2
2a
2a
2
1
D
1c
1b

CUTTER ELEMENTS FOR HOLLOW DRILL BIT

BACKGROUND OF THE INVENTION

The present invention is directed to a hollow drill bit formed out of a tubularly-shaped support member with cutter elements arranged at the leading end of the support member with the elements projecting radially outwardly beyond the outer surface of the support member.

Hollow drill bits of the above type are disclosed in DE-GM No. 8 515 322 and are used specially for cutting holes of large diameter in rock, concrete, masonry or the like. The cutter members are provided with abrasive cutting particles, particularly synthetic diamonds.

The drilling operation is carried out mostly along with a simultaneous supply of a cooling liquid. The supply of cooling liquid is effected at a more or less high pressure and mostly from the inside of the tubularly-shaped support member, whereby an outflow is assured along the outer side of the member carrying off drillings or drill chips. In actual practice, however, it is not always possible to provide a sufficiently high pressure for the cooling liquid for removing drill chips, particularly when using mobile drilling equipment.

SUMMARY OF THE INVENTION

Therefore, the primary object of the present invention is to create a hollow drilling tool or drill bit affording effective removal of drillings or drill chips from the drilled hole without increasing the apparatus required.

In accordance with the present invention, the cutter elements project outwardly from the outer surface of the support member for directing cooling liquid along with drillings toward the opening from the borehole. Such an advantageous flow is achieved, especially if the rotational direction of the drilling tool corresponds to the pitch direction of the channels.

Preferably, the cutter elements are provided on the inside of the support member, projecting inwardly from its inside surface and with at least one channel inclined relative to the axis of the support member, for carrying cooling liquid for the removal of drillings. The channel is open at its opposite ends, spaced apart generally in the circumferential direction, and at its inner edges. By arranging at least one channel opened inwardly at the radially inner surface of the cutter element, the cooling liquid can be conveyed along the inside surface to the base of the borehole. The pitch of the channel in the inside surface of the cutter element preferably extends in the opposite sense to the channel formed in the outside surface of the cutter elements Such an arrangement of the channels generates a flow of the cooling liquid toward the deepest part of the borehole at the inside surface of the cutter elements and provides the removal of the drillings along the outer surface of the cutter elements in the direction toward the borehole opening.

Preferably, several parallel channels are provided on each of the inner and outer surfaces of the cutter element. By providing a plurality of channels, the flow effect is increased as compared to a single channel. Further, since the cutter elements are worn down during use of the hollow drill bit, due to the arrangement of several channels parallel to one another, it is assured during the entire useful life of the drill bit that channels are available in the cutter elements for removal of the drillings.

In a preferred arrangement, the channels extend at a pitch angle of 30° to 60° for the removal of the drillings.

It is advantageous to provide the channels with a U-shaped cross section. The U-shaped cross-section of the channels can be angular at the corners or rounded off. The depth and width of the U-shaped cross-section preferably corresponds approximately to the dimension of the cutter elements projecting outwardly from the outer surface of the support member.

Another advantage of the channels in the present invention involves the increase of the surface of the cutter elements for improving heat transfer from the elements to the cooling liquid. Due to such improved heat transfer, overheating of the cutter elements can be avoided.

The various features of novelty which characterize the invention are pointed out with particularity in the claims annexed to and forming a part of this disclosure. For a better -understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a perspective view of a hollow drill bit embodying the present invention.

DETAILED DESCRIPTION OF THE INVENTION

The body of the hollow drill bit is formed by an axially extending tubularly-shaped support member 1 with a leading end 1*a*, that is, the end leading in the drilling direction, and a trailing end 1*b*. Trailing end 1*b* is formed as a connector stub 1*c* with a smaller diameter relative to the main part of the support member, for connection into a known drilling tool, not shown. In the region of the leading end 1*a*, the support member 1 has a plurality of generally U-shaped recesses 1*d* extending from the leading end toward the trailing end. Each recess contains a cutter segment 2. Each cutter segment 2 has a radially outer surface 2*a* facing outwardly and a radially inner surface 2*b* facing inwardly, that is, in the opposite direction with respect to the radially outer surface. Cutter elements 2 are provided on the radially outer surface 2*a* and the radially inner surface 2*b* with channels 2*c*, 2*d* open at the opposite ends in the generally circumferential direction and also open outwardly and inwardly between the ends. Channels 2*c*, 2*d* are inclined relative to the axis of the support member 1. As can be seen from the drawing, channels 2*c*, 2*d* are parallel to one another on the opposite surfaces of the cutter elements. The pitch angle A of the channels 2*c*, 2*d* is about 45°. The pitch direction of the channels 2*c*, 2*d* is opposite at the radially outer surface 2*a*, as compared to the radially inner surface 2*d*. As a result, when the hollow drill bit is rotated in the direction of the arrow D, a flow of a liquid or pasty cooling or lubricating agent is effected through the channels 2*d* in the radially inner surface 2*b* of the cutter elements, providing flow directed toward the leading end 1*a* of the support member, that is, towards the deepest part of the borehole being drilled. Channels 2*c* located in the radially outer surface 2*a* then convey the cooling agent along with the drillings produced in the drilling operation toward the trailing end 1*b* of the support member, that is, towards the opening out of the borehole.

Channels *2c*, *2d* can also be arranged on a portion of the cutter elements 2, or on one side of the cutter elements. In the last-mentioned arrangement, it is preferable to arrange the channels *2c* on the radially outer surface *2a* of the cutter elements 2.

While specific embodiments of the invention have been shown and described in detail to illustrate the application of the inventive principles, it will be understood that the invention may be embodied otherwise without departing from such principles.

We claim:

1. Hollow drill bit comprises an axially extending tubularly-shaped support member having a first end leading in the drilling direction and a second end trailing in the drilling direction, said support member has a circumferentially and axially extending outer surface and a circumferentially and axially extending inner surface, a plurality of cutter elements located at the first end of said support member, wherein the improvement comprises said cutter elements project at least radially from the outer surface of said support member, each said cutter element has a radially outer surface and a radially inner surface, the radially outer surface projecting outwardly from the outer surface of said support member has at least one channel for receiving drillings from the base of a borehole, said channel inclined relative to the axis of said support member, said channel extending generally circumferentially and being open at opposite ends thereof in the circumferential direction and also being open in the radially outer surface of said cutter elements.

2. Hollow drill bit, as set forth in claim 1, wherein said cutter elements have the radially inner surface thereof projecting radially inwardly from the inner surface of said support member, and the radially inner surface of said cutter segments having at least one channel extending generally circumferentially and being open at the opposite ends in the circumferential direction and in the radially inner surface of said cutter elements, and said channel in said radially inner surface being inclined relative to the axis of said support member.

3. Hollow drill bit, as set forth in claim 2, wherein a plurality of channels are formed in the radially inner surface and radially outer surface of said cutter elements with said channels being parallel to one another.

4. Hollow drill bit, as set forth in claim 3, wherein said channels in the radially inner surface and radially outer surface of said cutter elements are inclined at an angle in the range of 30° to 60° relative to the axis of said support member.

5. Hollow drill bit, as set forth in claim 3, wherein said channels in the radially inner surface and radially outer surface of said cutter elements have a U-shaped cross-section transversely of the generally circumferential direction thereof.

6. Hollow drill bit, as set forth in claim 3, wherein said drill bit has a drilling direction about the axis thereof, said radially inner surface and said radially outer surface of said cutter element each having an axially extending leading edge relative to the drilling direction of said support member, the ends of said channels in said radially inner surface at the leading edge being more remote from the first end of said support member than the opposite ends of said channels and said channels in said radially outer surface of said cutter elements being closer to the first end of said support member at the leading edge thereof than the opposite ends of said channels.

* * * * *